United States Patent [19]

Seeger, Jr.

[11] 4,046,975

[45] Sept. 6, 1977

[54] KEYBOARD SWITCH ASSEMBLY HAVING INTERNAL GAS PASSAGES PREFORMED IN SPACER MEMBER

[75] Inventor: Richard E. Seeger, Jr., Topsfield, Mass.

[73] Assignee: Chomerics, Inc., Woburn, Mass.

[21] Appl. No.: 615,230

[22] Filed: Sept. 22, 1975

[51] Int. Cl. [2] ..... H01H 13/04

[52] U.S. Cl. ..... 200/5 A; 200/159 B; 200/306; 200/302

[58] Field of Search ..... 200/5 R, 5 A, 86 R, 200/159 B, 306, 302, 340, 153 M

[56] References Cited

U.S. PATENT DOCUMENTS

| | | | |
|---|---|---|---|
| 3,383,487 | 5/1968 | Wiener | 200/159 B X |
| 3,393,284 | 7/1968 | Goble | 200/86 R |
| 3,590,195 | 6/1971 | Driver | 200/159 B |
| 3,617,660 | 11/1971 | Krakinowski | 200/159 B X |
| 3,718,791 | 2/1973 | Szablowski | 200/86 R X |
| 3,723,673 | 3/1973 | Clary et al. | 200/159 B X |
| 3,829,632 | 8/1974 | Klehm, Jr. | 200/159 B X |
| 3,860,771 | 1/1975 | Lynn et al. | 200/159 B X |
| 3,898,421 | 8/1975 | Suzumura | 200/159 B |

OTHER PUBLICATIONS

Harper et al., Jour. Med. Chem., vol. 7 (1964) pp. 729–732.

*Primary Examiner*—James R. Scott
*Attorney, Agent, or Firm*—Sewall P. Bronstein; Donald Brown

[57] ABSTRACT

Sealed keyboard sandwich having actuator means, a plurality of contactor means, a plurality of contact means and support means therefore, said contacts and contactors forming a plurality of key units, and gas passage means positioned between said actuator means and said support means for selectively permitting the flow of trapped gas from the key units upon depression of a portion thereof. In the preferred structure the sandwich is hermetically sealed from the outside atmosphere.

9 Claims, 12 Drawing Figures

KEYBOARD SWITCH ASSEMBLY HAVING INTERNAL GAS PASSAGES PREFORMED IN SPACER MEMBER

BACKGROUND OF THE DISCLOSURE

This invention is directed to keyboard sandwiches which are sealed together. In the preferred form of the disclosure the keyboard is hermetically sealed from the outside atmosphere to prevent contamination of the interior contacting parts thereof.

In addition, in certain instances, e.g., in certain military applications, the interior thereof is also pressure vented to facilitate operation at various atmospheric pressures, e.g., at high altitudes.

Keyboard structures such as shown in U.S. Pat. Nos. 3,860,771; 3,862,381 and 3,862,382 have gained wide acceptance. Such keyboard structures are held together by the keyboard frame via posts extending downwardly therefrom.

While such manner of construction is quite acceptable there has developed a demand for sealed keyboard structures which provide for contactor and contact isolation from the outside environment thereby preventing degradation thereof by moisture, etc.

The present invention provides such a keyboard construction as a sealed sandwich which in the preferred embodiment is hermetically sealed from the outside enviroment. To facilitate such construction and the proper functioning of the keyboard sandwich, there is provided herein a new and improved construction for permitting the passage of gas as an actuator portion thereof is depressed to force contactor means against contact means.

The present invention because of its sandwich construction is readily saleable absent a frame and thus may be incorporated into various structures e.g., calculators, machine control systems, telephones, radios and televisions for controlling the operation of same.

BRIEF DESCRIPTION OF THE DISCLOSURE

The keyboard of this invention in its most preferred form comprises a hermetically sealed sandwich having a plurality of isolated key units each comprising actuator means, contactor means, contact means and support therefore and a gas passage means interconnecting certain of said key units in a predetermined pattern.

Thus upon depression of said actuator of one of said key units gas trapped therein may temporarily be forced into another of the key units to avoid the mushy feeling which would occur if the gas had no place to go.

In the preferred construction a single sheet serves as the actuator for all key units and selected portions thereof are depressed to achieve contactor to contact closure. In addition, for certain applications, the gas passages are pressure vented.

DETAILED DESCRIPTION OF THE DISCLOSURE

Figure 1:
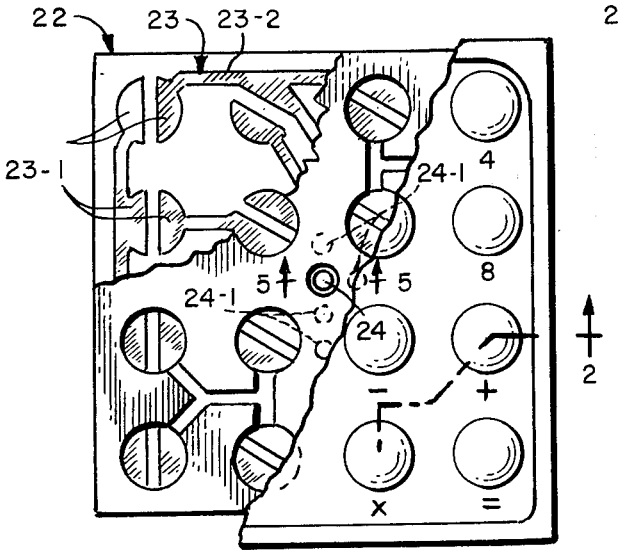
FIG. 1 is a top plan view with parts broken away showing the keyboard of this invention.
Figure 3:
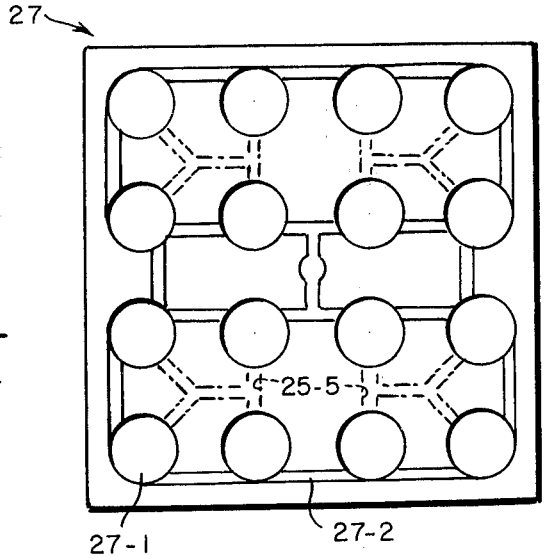
FIG. 3 is a view of the underside of the actuator showing the circuit pattern between the actuators and illustrating as dotted the air passages between contactors.

Reference should now be had to FIGS. 1–12 for a description of the preferred embodiment of the disclosure. The keyboard including the sandwich 21 of this invention is shown at 20 and comprises an outer frame e.g., of plastic having a top 20-1 coupled to a bottom 20-2. Obviously, other frame configurations may be used depending upon its ultimate use.

The keyboard sandwich of this invention comprises an insulator base support 22 which be of plastic e.g., Bakelite, glass, etc., which may be flexible or rigid depending upon the application.

A circuit pattern 23 comprising a plurality of contact means 23-1 is supported by the base 22. The contactors are interconnected by the conductive elements 23-2 in a manner that depends upon the code to be generated at the output of the keyboard as will be apparent to those skilled in the art.

Reference may be had to the aforementioned U.S. Patents, as well as U.S. Pat. No. 3,721,778 which shows a typical or etched copper circuit pattern for generating a coded output at terminal pins 24 shown in FIG. 5 or at like pins shown in the aforementioned patents. Obviously the circuit pattern 23 may also be printed using any electrically conductive ink.

Positioned above the circuit board (the base plus the circuit pattern) there is provided an adhesive layer 25 which functions as a mask and which comprises center layer 25 preferably of plastic e.g., Mylar having pressure sensitive adhesive on both sides at 25-2 and 25-3.

The layer 25 has a plurality of holes 25-4 in alignment with selective contacts 23-1 so that a contactor may engage selective contacts to complete a circuit. The layer 25 preferably acts as an insulator spacer with at least the adhesive 25-2 and 25-3 in contact with the circuit patterns being electrically non-conductive.

Figure 4:
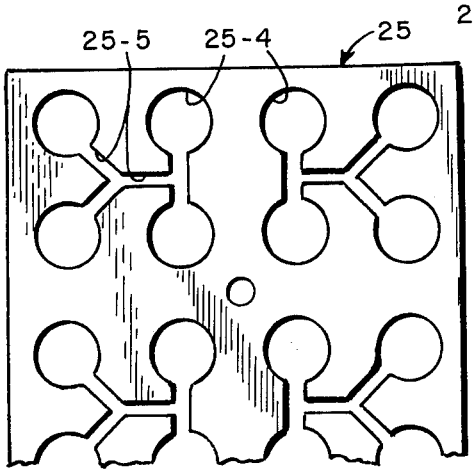
FIG. 4 is a partial top view of the mask or spacer shown in FIG. 1.

The layer 25 is also provided with a plurality of gas passages 25-5 which interconnect with holes 25-4 (see FIG. 4). The layer 25 preferably is constructed by stamping out the holes 25-4 and passages 25-5 in a conventional manner.

The layer 25 may preferably comprise a Mylar coated top and bottom with a pressure sensitive adhesive, Nycal, and sold by Northern Engraving Co. of Sparta, Wis.

Positioned over layer 25 is an actuator layer 26 comprising a sheet of flexible and resilient material preferably plastic e.g., Mylar, as shown in U.S. Pat. No. 3,860,771, and having a plurality of actuator protrusions 26-1 positioned in selective alignment with contacts 23-1 and holes 25-4.

The protrusions preferably comprise a pedestal 26-2 capped with a convex curved surface 26-3. Positioned on and supported by the under surface of layer 26 is a second circuit pattern 27 which comprises contactors 27-1 and circuit interconnecting elements 27-2. The circuit pattern may be formed of conductive plastic ink as disclosed in U.S. Pat. No. 3,860,771.

Figure 2:
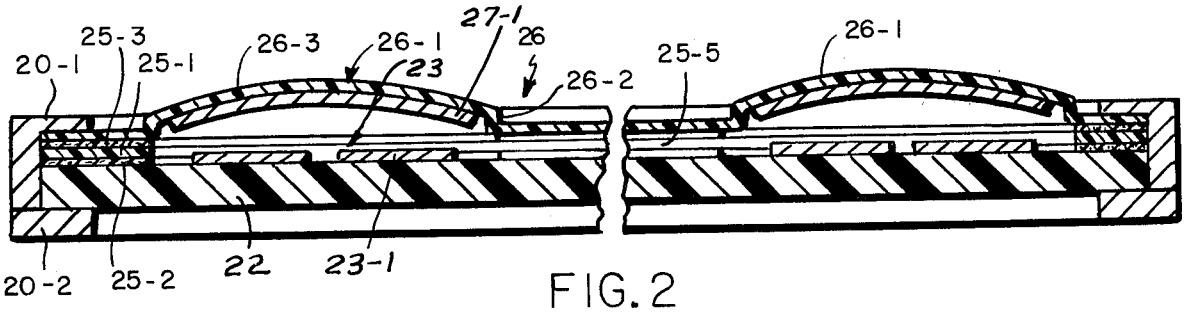
FIG. 2 is a sectional view taken along line 2—2 in FIG. 1.

FIG. 2 shows the sandwich together and illustrates a hermetically sealed unit, i.e., one in which air and moisture is prevented from entering from the outside environment. While adhesive is used to seal the sandwich it should be realized that the assembly could alternatively be heat sealed to form a hermetically sealed package.

Figure 5:
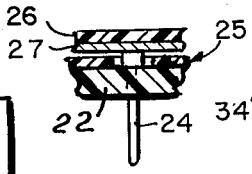
FIG. 5 is a sectional view taken aong line 5—5 in FIG. 1 showing coupling of a connecting pin to the actuator supported circuit pattern.

The pin 24 shown in FIG. 5 is coupled to circuit pattern 27 so that it is at a common potential whereas other pins 24-1 in FIG. 1 shown dotted are selectively coupled to the contacts 23-1 or conductive elements 23-2 leading therefrom to generate the coded output from the keyboard. See the aforementioned U.S. patents for further details on the connection of pins for a keyboard.

The gas passages 25-5 function to direct gas such as trapped air back and forth between the spaces between contactors and contacts of each key unit so that when compressed the actuator protrusions can be easily forced downwardly to cause contactors and contacts to be electrically connected.

It has been found that without the gas passages 25-5 a mushy feeling is felt by the user and in many cases a vacuum will be formed if the trapped gas is somehow under high forces pushed past by the adhesive. In this event it has been found that suction has not let the protrusion (26-2 and 26-3) return to its raised state as shown in FIG. 2 after being depressed.

Thus by the expediency of gas passages 25-5 which permits gas to flow back and forth between the layers 26 and 22 and into the spaces between other undepressed contacts and contactors of other isolated key units there has been provided a keyboard which will properly function even when hermetically sealed.

Figure 7:
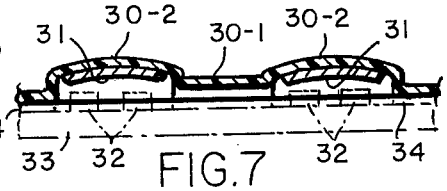
FIG. 7 is a sectional view taken along line 7—7 in FIG. 6.
Figure 8:
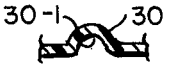
FIG. 8 is a sectional view taken along line 8—8 in FIG. 6.
Figure 6:
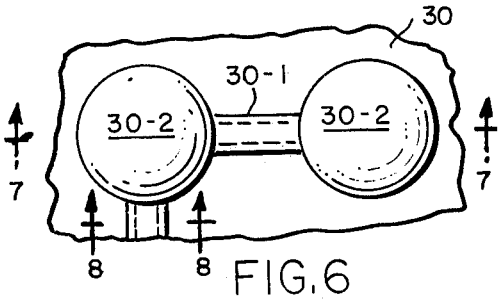
FIG. 6 is a portion of a top view of an alternate embodiment of the disclosure.

Reference should now be had to FIGS. 6–8 which show a modification of the structure shown in FIGS. 1–5. In these Figs. the gas passages are formed in an actuator sheet 30 rather than in the mask at 30-1 and are positioned between selective protrusions 30-2.

Contactors 31 are shown supported by the layer 30 above contact means 32 supported on base layer 33. The unit is sealed together by adhesive 34.

Figure 9:
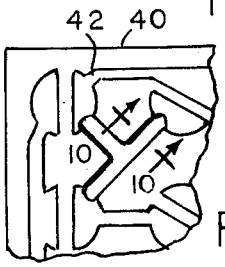
FIG. 9 is a top view of another alternate embodiment of the disclosure.
Figure 10:
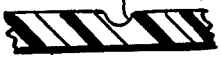
FIG. 10 is a sectional view taken along line 10—10 in FIG. 9.

FIGS. 9 and 10 illustrate yet another alternate scheme for providing gas passages. In these Figs. the gas passages are formed in the base 40 at 40-1, rather than in the mask or actuator layers. The circuit pattern is shown at 42.

Figure 11:
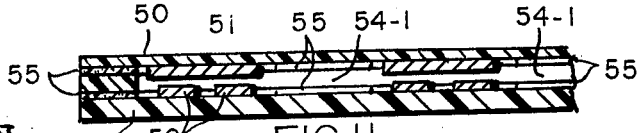
FIG. 11 illustrates in a sectional side view another alternate embodiment of the disclosure.

FIG. 11 shows the use of the gas passages disclosed in this invention in a flat keyboard construction. In this view a plastic actuator top sheet e.g., of Mylar or rubber 50 supports contactors 51 over contacts 52 supported by base 53. An adhesive mask 54 is provided which has a gas passage 54-1. The mask is sealed to layers 50 and 53 by adhesive 55.

Figure 12:
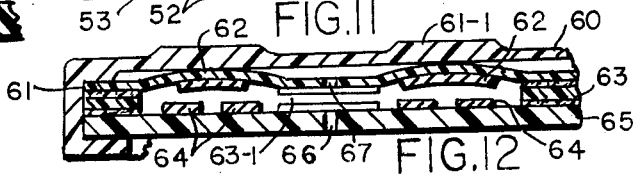
FIG. 12 illustrates in sectional side view a further alternate embodiment of the disclosure.

In FIG. 12 there is shown a further embodiment wherein a protective cover 60 is provided over a keyboard sandwich having an actuator sheet 61 with a plurality of convex protrusions 61-1 (without pedestal) that support contactors 62. An adhesive spacer or mask is provided at 63 as in FIGS. 1-5 which has an air passage 63-1 between adjacent spaces of key units which comprise actuator contactors 62 and contacts 64 supported by board 65.

In FIG. 12 air pressure vent holes are provided into gas passage 63-1 at 66 and 67 which extend through actuator top 61 and board 65.

Thus there is provided in the preferred embodiment of this invention a plurality of isolated and sealed off key units comprising actuator means, contactors, contacts and support therefore which are selectively coupled to one another by a gas passage. In addition in certain application pressure venting is provided to the gas passages.

What is claimed:

1. A keyboard sandwich comprising a bottom layer of insulator plastic, electrically conductive contacts supported on one side of said bottom layer, an insulator spacer layer positioned against said bottom layer side supporting said contacts, said spacer having a plurality of sets of openings therethrough from the top to the bottom surface thereof, each opening in register with at least one different contact and at least extending about substantially said entire contact in register therewith, a top layer of resilient and flexible plastic positioned against said spacer layer, said top layer supporting a plurality of contactors, at least one contactor in register with each of said openings, and a plurality of passages in said spacer layer which are substantially narrower in width than said openings and extending therethrough from the top to the bottom surface thereof, and different ones of said passages extending between each different set of said openings, said spacer top and bottom surfaces sealed to said top and bottom layers about said openings and said passages, whereby upon depression of a contactor into one of said openings of a set, gas trapped in said opening will move into others of said opening of said set, said top layer includes a plurality of protrusions in register with a different one of said openings, each protrusion supporting at least one different contactor on the underside thereof and in which a vent hole extends through at least said top or bottom layers and opens into one of the narrow passages.

2. A keyboard sandwich comprising a bottom layer of insulator plastic electrically conductive contacts supported on one side of said bottom layer, an insulator spacer layer positioned against said bottom layer side supporting said contacts, said spacer having a plurality of sets of openings therethrough, each opening in register with at least one different contact and at least extending about substantially said entire contact in register therewith, a top layer of resilient and flexible plastic positioned against said spacer layer supporting a plurality of contactors, at least one contactor in register with each of said openings, said top layer having open channel gas passages formed therein between different sets of said openings to permit gas trapped in each set of openings to move between openings of said set upon movement of a contactor into an opening of a set, said bottom layer sealed to said spacer layer about said openings and said top layer sealed to said spacer layer about said openings and said passages.

3. The keyboard sandwich of claim 2 in which said passages in said top layer are substantially narrower in width than said openings.

4. The keyboard sandwich of claim 3 in which said top layer includes a plurality protrusions in register with a different one of said openings, each protrusion supporting at least one different contactor on the underside thereof.

5. The keyboard sandwich of claim 4 in which a vent hole extends through at least said top or bottom layers and open into one of said narrow passages.

6. A keyboard sandwich comprising a bottom layer of insulator plastic, electrically conductive contacts supported on one side of said bottom layer, an insulator spacer layer positioned against said bottom layer side supporting said contacts, said spacer having a plurality of openings therethrough, each opening in register with at least one different contact and at least extending about substantially said entire contact in register therewith, a top layer of resilient and flexible plastic positioned against said spacer layer and supporting a plurality of contactors, at least one contactor in register with each of said openings, said bottom layer having open channel gas passages formed therein between different sets of said openings to permit gas trapped in each set of openings to move between openings of said set upon movement of a contactor into an opening of a set, said top layer sealed to said spacer about said openings and said bottom layer sealed to said spacer about said openings and said passages.

7. The keyboard sandwich of claim 6 in which said passages in said top layer are substantially narrower in width than said openings.

8. The keyboard sandwich of claim 7 in which said top layer includes a plurality protrusions in register with a different one of said openings, each protrusion supporting at least one different contactor on the underside thereof.

9. The keyboard sandwich of claim 8 in which a vent hole extends through at least said top or bottom layers and open into one of said narrow passages.

* * * * *